United States Patent [19]

Rice

[11] B 3,981,149

[45] Sept. 21, 1976

[54] HYDRAULIC CASCADE DRIVE SYSTEM

[75] Inventor: Richard M. Rice, Afton, Va.

[73] Assignee: Reynolds Metals Company, Richmond, Va.

[22] Filed: June 6, 1975

[21] Appl. No.: 584,520

[44] Published under the second Trial Voluntary Protest Program on January 27, 1976 as document No. B 584,520.

Related U.S. Application Data

[63] Continuation of Ser. No. 433,838, Jan. 15, 1974, abandoned.

[52] U.S. Cl. ..... 60/424; 60/468; 60/484; 60/486

[51] Int. Cl.[2] ..... F15B 11/16

[58] Field of Search ..... 60/384, 420, 424, 484, 60/486, 468

[56] References Cited

UNITED STATES PATENTS

| | | | |
|---|---|---|---|
| 2,846,849 | 8/1958 | Levetus et al. | 60/384 |
| 3,038,312 | 6/1962 | Marsh | 60/420 |
| 3,348,624 | 10/1967 | Just et al. | 60/484 X |

FOREIGN PATENTS OR APPLICATIONS

| | | | |
|---|---|---|---|
| 271,662 | 2/1951 | Switzerland | 60/484 |

*Primary Examiner*—Edgar W. Geoghegan
*Attorney, Agent, or Firm*—Glenn, Palmer, Lyne & Gibbs

[57] ABSTRACT

A cascade drive system is disclosed for use in processes that deal with continuous lengths of material such as film, wire, paper, fabric, etc. The system includes a plurality of stages holding fixed speed ratios to each other; and uses hydraulic components arranged in a series flow circuit, in such a way that the line speed may be synchronously increased or decreased and individual ratios between adjacent stages may be changed.

18 Claims, 7 Drawing Figures

FIG.5
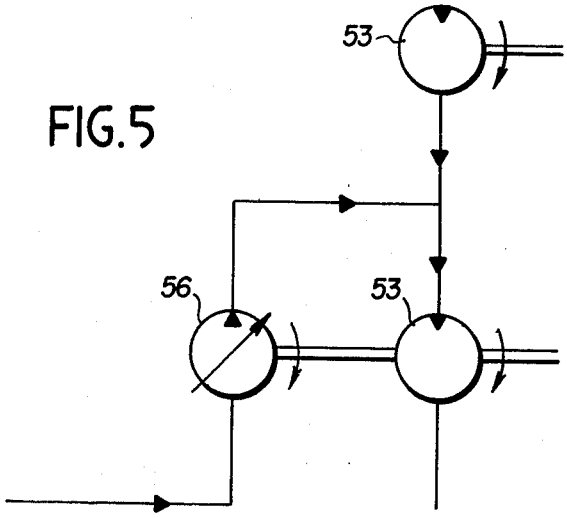
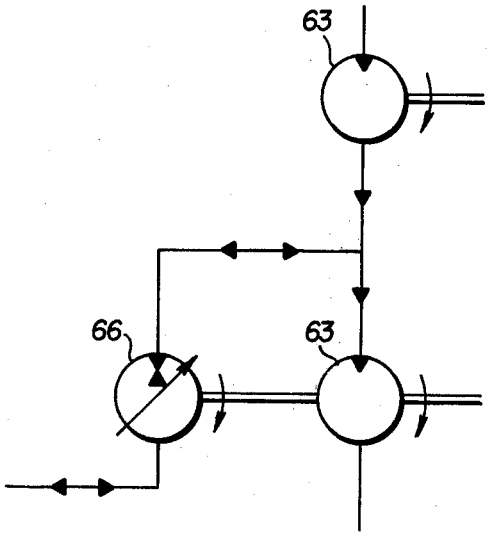
FIG.6
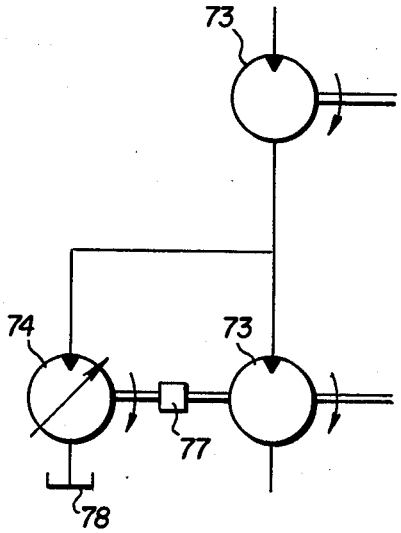
FIG.7

HYDRAULIC CASCADE DRIVE SYSTEM

This is a continuation of application Ser. No. 433,838 filed Jan. 15, 1974, now abandoned.

BACKGROUND OF THE INVENTION

The invention relates to cascade drive systems which are commonly used in processes that deal with continuous lengths of material such as film, wire, paper, fabric, etc. In particular, it relates to a method of creating a cascade drive system using hydraulic components which are arranged in a series flow circuit in such a way that adjustment of the speed of any output shaft proportionately and synchronously adjusts the speed of all subsequent output shafts in the system.

Present methods of achieving such cascade drive systems are by use of electronic control of DC motors in what are called tach-follower systems, and by placing mechanical speed variators between adjacent stages of a drive system. However, these methods create certain distinct disadvantages. In this regard, an electronic drive system involves considerable cost, bulky size, and the necessity to incorporate regenerative drives on stages that handle over-hauling loads. That is, loads that actually add power back to the drive system because of energy received from the processed material. Although the cost of mechanical speed variator drive systems is comparatively low, speed regulation achieved is relatively poor. Also, mechanical speed variators place stringent requirements on relative location of the various stages of the drive system, since all power must be transferred by chains, belts, gears, or the like.

Hence, for efficiency and adaptability, a cascade drive system is needed which is low in cost, reasonable in size, flexible in arrangement, and can transmit relatively large quantities of power with good speed and ratio regulation. It is an object of this invention to provide a cascade drive system for efficiently regulating speeds and speed ratios throughout the system.

It is another object to provide a cascade drive system capable of regeneration of power from over-hauling loads.

It is a further object to provide a cascade drive system with a flexible spatial relationship between the various stages of the drive system.

It is yet another object to provide a cascade drive system at a fractional cost of an equivalent electronic system, while maintaining approximately equal control features.

Still another object is to provide a cascade drive system with relatively small components that are capable of transmitting large quantities of power.

SUMMARY OF THE INVENTION

In accordance with principles of this invention, the objects as set forth are attained by providing a cascade drive system using hydraulic components arranged in a series flow circuit. The system includes an electric motor-powered hydraulic pump which in turn drives a plurality of fixed displacement hydraulic motors in series. Each of these fixed displacement motors drives one stage of a multi-stage process. Coupled directly to the fixed displacement motors are individual variable displacement motors.

The speed ratio between adjacent stages is controllable by adjusting the setting of an associated variable displacement motor which diverts a certain percentage of incoming flow to the corresponding fixed displacement motor from the preceding stage. Such a diversion synchronously changes the line speed of all subsequent stages and alters the speed ratio between the adjusted stage and the preceding stage. Overall line speed is controlled by varying the displacement of the variable displacement pump.

BRIEF DESCRIPTION OF THE DRAWINGS

FIGS. 5, 6, and 7 are schematic drawings illustrating additional arrangements of components.

DESCRIPTION OF PREFERRED EMBODIMENTS

Figure 1:
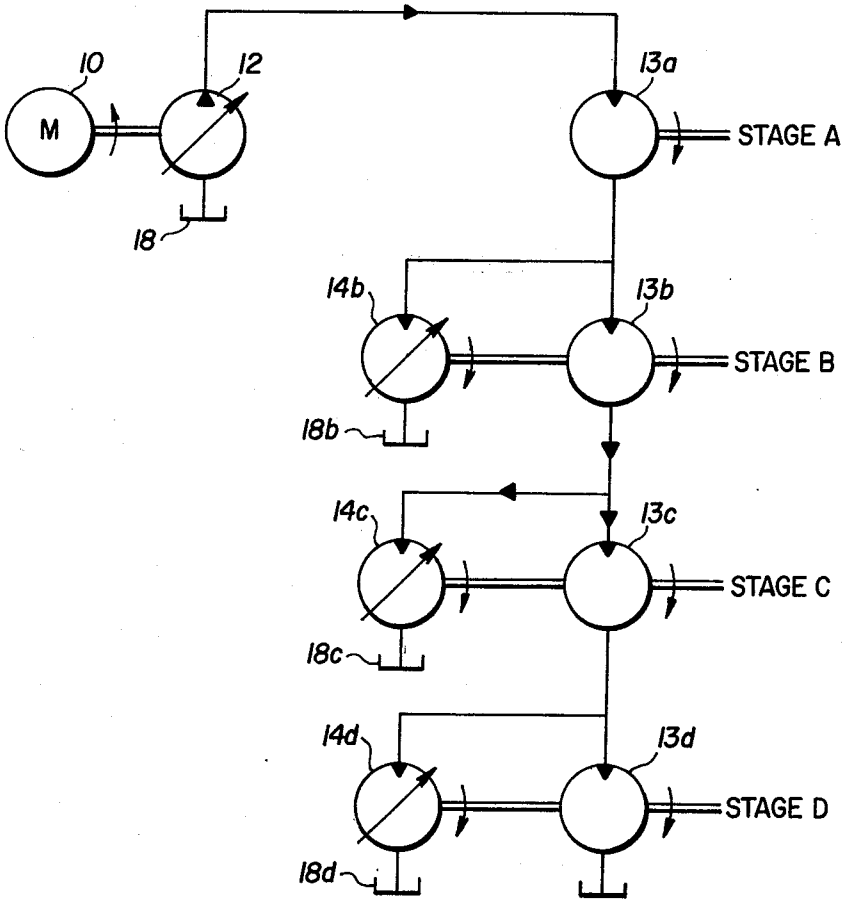
FIG. 1 is schematic drawing illustrating an arrangement of components whereby a forward cascade system is achieved.

The foregoing and other objects, features, and advantages of the invention will be apparent from the following more particular description of preferred embodiments of the invention as illustrated in the accompanying drawings in which like series of reference characters refer to the same parts throughout the different views. The drawings are not necessarily to scale, emphasis instead being placed on illustrating principles of the invention.

Referring to elements of the invention as embodied in the drawings, FIG. 1 schematically represents a hydraulic cascade drive system with the various hydraulic components arranged to achieve a forward cascade drive system. The system comprises an electric motor 10 which mechanically drives a variable displacement hydraulic pump 12, which in turn hydraulically drives hydraulic motors 13*a*, 13*b*, 13*c*, and 13*d* in series. These motors are fixed displacement motors; each of which mechanically drives an output shaft for one stage of a four stage process. Variable displacment motors, 14*b*, 14*c* and 14*d* are mechanically coupled directly to the fixed displacement motors 13*b*, 13*c* and 13*d* respectively.

Following the flow pattern of the drawing, hydraulic fluid passing through the fixed displacement motor on one stage subsequently must pass through the motor-set of the next stage. This fluid is selectively apportioned, however, between the fixed and variable displacement motors 13 and 14. Hence, the speed ratio between the outputs of adjacent stages is selectively controllable by adjusting the setting of the adjacent downstream variable displacement motor which diverts a certain percentage of the incoming flow from the preceding stage. This diversion of fluid from the series flow circuit reduces the quantity of fluid flow through all subsequent stages. Accordingly, the line speed of all subsequent stages is synchronously changed, at the same time that the speed ratio between the two adjacent stages is changed. For example, increasing the output of variable displacement motor 14*b* decreases the output speed ratio between stage A and stage B (i.e.

the speed of stage B divided by speed of stage A) and synchronously reduces the output shaft speed of stages B, C and D.

The overall line speed also can be controlled by varying the displacement of the main variable displacement pump 12. By increasing the flow from this pump, all stages of the process are proportionally increased in speed. Conversely, decreasing the displacement of pump 12 reduces the fluid flowing through the total series circuit, thereby proportionally reducing the speed of all outputs of the total system.

A great advantage of the component arrangement of the above system is that all fluid that is diverted through the variable displacement motors and the fluid pressure differential thereacross actually helps drive the load on the respective stage. Therefore, there is no loss in power or energy due to this diverted flow, as commonly occurs in other hydraulic systems that divert flow back to a reservoir and incur energy losses through the use of pressure relief valves or the like. In other words, the above described cascade drive system with variable displacement motors connected to fixed displacement motors obviates the loss of energy and power due to pressure drops across conventionally employed pressure control valves and flow control valves.

The system of the invention is totally regenerative in the event of over-hauling loads on the respective stages. That is, an over-hauling load actually tends to be retarded by the related fixed displacement motor, thereby causing the motor to act as a pump to increase the system pressure whereby the energy from the over-hauling load is reclaimed. Thus, the power is taken out of the load, and overspeed of the related output shaft is prevented. The absence of energy and power losses as described above, and the ability of the system to be regenerative to reclaim energy from the load, minimizes heat build up in the system fluid and allows the use of much smaller prime movers.

The above described forward cascade system is used in processing systems where it is desired to hold the input speed of the processed material essentially constant. Any variation from this desired input speed can be adjusted by changing the output of pump 12 without there being any undesired change in the speed ratios between successive stages. The overall objective of such systems, however, is to selectively vary the ratios within the system so that only output speed and not the input speed is changed.

Other processes require changes of the input speed without changing the output speed. This type of system, designated a backward cascade drive system, is illustrated by the component arrangement of FIG. 2. The operational mode of this system is the reversal of the forward cascade system illustrated in FIG. 1. In this arrangement, speed ratio changes within the system cause preceding stages to change line speed, rather than permit line speed to be altered in subsequent stages as in the forward cascade drive system.

Figure 2:
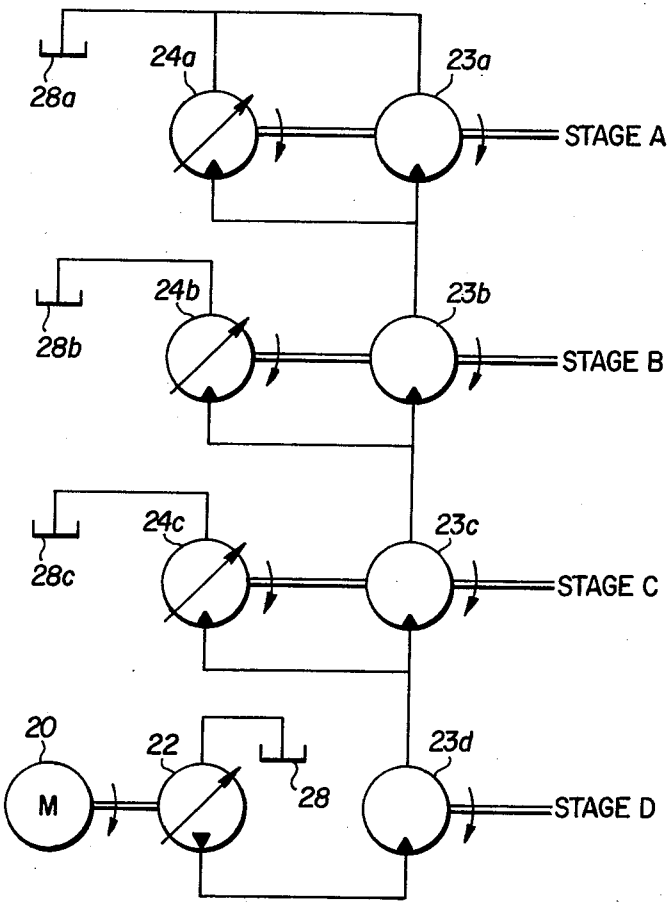
FIG. 2 is schematic drawing showing an arrangement of components, oppositely oriented from FIG. 1, whereby a backward cascade system is achieved.

In FIG. 2 the processed material still moves in the same direction as in FIG. 1 — from Stage A through Stage D — but motor 20 causes the main variable displacement pump 22 to maintain the shaft speed of output stage D substantially constant while the ratios and speeds of input stages A, B, and C can be selectively varied by adjusting the outputs of variable displacement hydraulic motors 24*a*, 24*b*, and 24*c* respectively.

Figure 3:
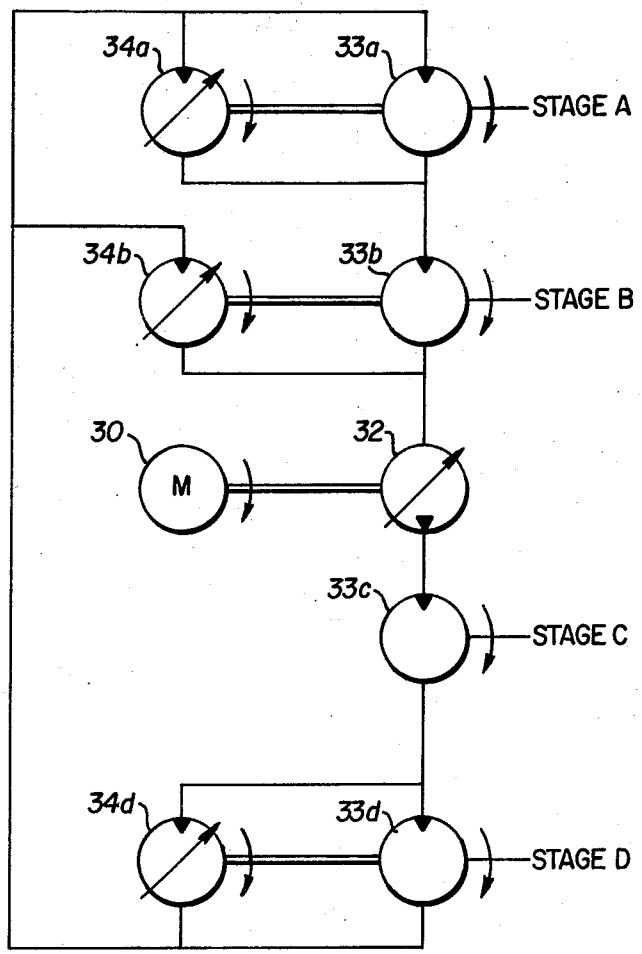
FIG. 3 is a schematic drawing in which the components are arranged to achieve a closed loop, combination, backward and forward cascade system.

Utilizing the preceding principles, various other drive configurations also are possible. Such an alternate system is depicted in FIG. 3. In that embodiment, the processed material is still moved in the same direction (from Stage A toward Stage D), but it is desired that the interior stage be maintained at a substantially constant speed rather than either input stage A (as in FIG. 1) or output stage D (as in FIG. 2).

In FIG. 3 it is stage C that is maintained substantially constant by controlling the output of variable displacement hydraulic pump 32, while the speeds and ratios of the other stages A, B, and D can be varied by adjusting the amount of fluid that bypasses motors 33 through the mechanically coupled variable displacement hydraulic motors 34A, 34B, and 34D.

The FIG. 3 system is a backward-type cascade system up to stage C and a forward-type cascade system after stage C. Stage C is a master drive or master stage.

FIG. 3 also illustrates a closed loop system that returns all fluid to the inlet of the main variable displacement pump 32 without a reservoir as is used in open loop systems. Any of the other systems described can also be arranged for a closed loop system, if desired.

Figure 4:
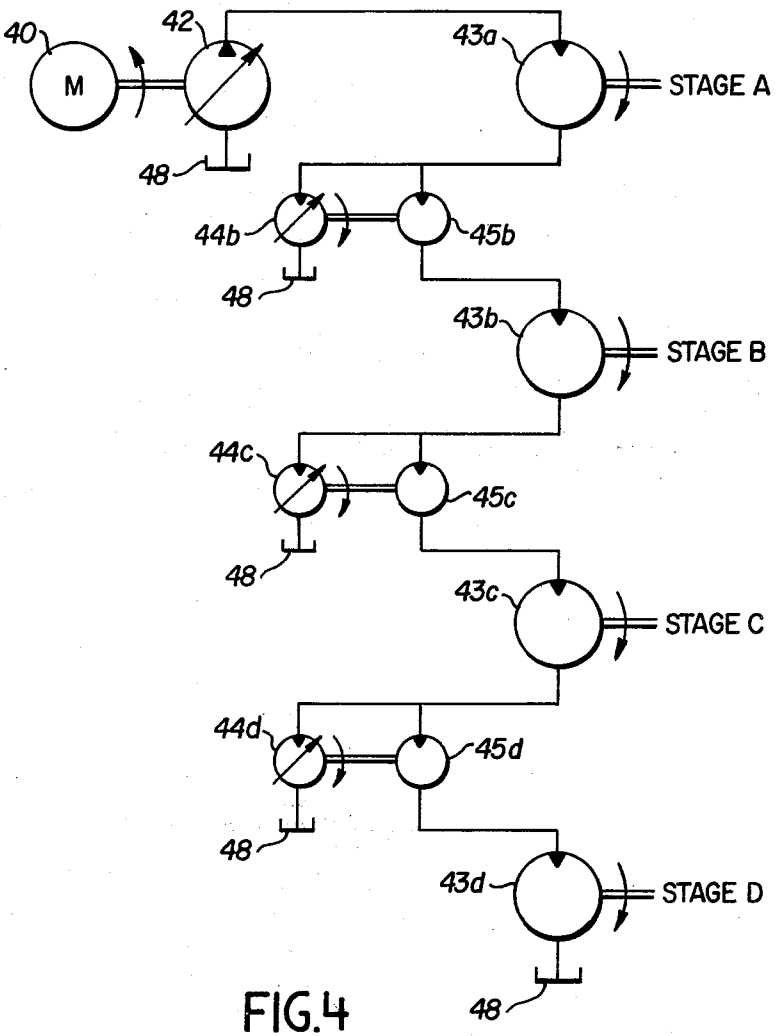
FIG. 4 is a schematic drawing representing a somewhat different arrangement of components in which a variable speed motor is not directly coupled to a fixed speed drive motor on each stage.

Another embodiment of the invention is illustrated in FIG. 4. In this system, rather than mechanically coupling the variable displacement hydraulic motors directly to the fixed displacement hydraulic motors 43 in respective stages, the variable displacement hydraulic motors 44 are mechanically coupled to corresponding supplemental fixed displacement hydraulic motors 45 which are hydraulically coupled in series flow to the main fixed displacement motors 43. In this manner ratio-flow control is obtained between the various stages. This two-motor combination for ratio flow control is free-wheeling, because the motors are not directly coupled to the load. The ratio flow control has the capability of splitting flow from a preceding stage into any desired ratio of fluid reverted back to the reservoir or on to the next stage. Inclusively, this system also has the ability to be regenerative. It can reclaim energy out of over-hauling loads and convert it to pressure back into the drive system. Also, pressure energy of the fluid that is being shunted back to the reservoir is recovered.

Just as in the system described above and illustrated in FIG. 1, this alternate arrangement of FIG. 4 can also be rearranged to operate as a backward cascade system, or a combination backward-forward cascade system, or it can be made into a branched cascade system where the output of one of the main fixed displacement motors 43 is delivered to two of the two-motor sets 44–45.

Another embodiment shown in FIG. 5, illustrates a "shunt-pump" arrangement wherein one or more of the variable displacement motors such as 14 in FIG. 1 is replaced by a variable displacement pump 56. This variable displacement pump 56 is mechanically coupled to the fixed displacement motor 53 and also adds fluid to the motor's input rather than subtracting the flow as in the "shunting-motor" arrangements of FIGS. 1, 2, 3, and 4. This particular method of speed-ratio control offers the advantage of maintaining high flow rates in later stages. The maintenance of these later-stage high flow rates is sometimes difficult to achieve in multi-stage cascade systems. This shunting-pump arrangement, therefore, has particular utility when used in combination with shunting-motor arrangements to maintain fluid flow at desirable high levels throughout complex systems.

Illustrated in FIG. 6 is a further embodiment using a variable pump-motor 66 which can be adjusted from full pump displacement through zero to full motor displacement in a reverse fluid flow direction while unidirectionally rotating the shaft of its associated motor 63 for operation in either mode.

FIG. 7 illustrates yet another embodiment which employs a transmission such as geared mechanical connections 77 between the fixed displacement hydraulic motors 73 and the variable displacement hydraulic motors 74. These transmission sections 77 provide additional flexibility of selection of speed ratios between adjacent stages. This arrangement has the effect of multiplying (or dividing) the relative displacement of the variable displacement motors 74 (or pumps in the case where such gear connections are employed in the FIG. 5 or FIG. 6 embodiments.)

While the invention has been particularly shown and described with reference to preferred embodiments thereof, it will be understood by those skilled in the art that various alterations in form and detail may be made therein without departing from the spirit and scope of the invention. For example, other relatively noncompressible matter such as particulate solids can be used and additional arrangements or modifications of the forward, backward, or combined systems described can be made without departing from the overall concept. Further, many options can be added to the basic system using standard components such as direction control and relief valves. Options such as clutching, braking, reversing, closed loop operation, free-wheeling, torque limiting, power servoing, and others can be readily achieved in accordance with common practice to fit the many applications in which cascade drive systems are used.

The embodiments of the invention in which an exclusive property or privilege is claimed are defined as follows:

1. A cascade fluid drive system comprising:

a power supply having a variable displacement fluid pump and means for driving said pump;

a plurality of fluid motors arranged in series flow circuit with each other and said fluid pump so that a change in the output of said pump tends to cause a change in the output speeds of said fluid motors; and variable fluid-displacement means for selectively varying the amount of fluid directed to at least one of said fluid motors to change its speed without changing the output speed ratio between said one fluid motor and an adjacent fluid motor in said series flow circuit; said variable fluid-displacement means being effective for synchronously changing the output speed of the remaining subsequent fluid motors in said series flow circuit to maintain the same speed ratio between said one fluid motor and each of said subsequent fluid motors as the speed of said one fluid motor is changed.

2. A cascade fluid drive system comprising:

a power supply having a variable displacement fluid pump and means for driving said pump;

a plurality of fluid motors arranged in series flow circuit with each other and said fluid pump so that a change in the output of said pump tends to cause a change in the output speeds of said fluid motors;

variable fluid-displacement means for selectively varying the amount of fluid directed to at least one of said fluid motors and arranged for both;

selectively varying the output speed ratio between said one fluid motor and an adjacent fluid motor in said series flow circuit; and synchronously changing the output speed of the remaining subsequent fluid motors in said series flow circuit; and fluid conducting means for conducting fluid between said variable fluid-displacement means and a point in said series flow circuit leading to said one fluid motor, the amount of fluid being controlled by said variable fluid-displacement means.

3. The system of claim 2 including a reservoir means and wherein the output of said variable fluid-displacement means is directed to said reservoir means and said variable displacement fluid pump receives its fluid supply from said reservoir means.

4. The system of claim 2 wherein said variable displacement fluid pump is located in said series flow circuit before the first of said fluid motors so that said system is a forward cascade system wherein the output speed of said first fluid motor is adapted to be maintained substantially constant.

5. The system of claim 2 wherein said variable displacement fluid pump is located in said series flow circuit after the last of said plurality of fluid motors to form a backward cascade system wherein the output speed of said last fluid motor is adapted to be maintained substantially constant.

6. The system of claim 2 wherein said variable displacement fluid pump is located in said series flow circuit immediately preceding an intermediate one of said plurality of fluid motors so that said system operates in a forward cascade manner for stages subsequent to the stage corresponding to the intermediate fluid motor and operates in a backward cascade manner for stages preceding the stage corresponding to said intermediate fluid motors; and wherein the output speed of said intermediate stage is adapted to be maintained substantially constant.

7. The system of claim 2 wherein said variable fluid-displacement means is connected in said series flow circuit in series with said one fluid motor, and arranged for selectively diverting fluid from said circuit on the inlet side of said one fluid motor.

8. The system of claim 7 wherein said variable fluid-displacement means includes a variable displacement fluid motor connected to a supplemental fluid motor of fixed displacement and arranged so that said selectively diverted fluid passes through said variable displacement fluid motor and said fixed displacement fluid motor is in series with said one fluid motor.

9. The apparatus of claim 2 wherein said variable fluid-displacement means comprises a shunting pump arrangement for adding fluid to the input of said one fluid motor.

10. The system of claim 2 wherein said variable fluid-displacement means is adapted to be selectively operated as a variable displacement fluid pump or a variable displacement fluid motor.

11. The system of claim 2 including a transmission means connected between said one fluid motor and said variable fluiddisplacement means to change the relative displacement of said variable fluid displacement means.

12. The system of claim 1 wherein said one fluid motor has a fixed displacement, and including a second variable fluid-displacement means for another of said fluid motors, the latter also having a fixed displacement, and being separated from said one fluid motor by no more than one intermediate motor in said series flow circuit, each of said variable fluid-displacement means being operable independently of the other to change the output speed of its corresponding fluid motor, without changing the speed ratio between said corresponding motor and an adjacent subsequent motor in said series flow circuit.

13. A cascade fluid drive system comprising:

a power supply having a variable displacement fluid pump and means for driving said pump;

a plurality of fluid motors arranged in series flow circuit with each other and said fluid pump so that a change in the output of said pump tends to cause a change in the output speeds of said fluid motors;

variable fluid-displacement means for selectively varying the amount of fluid directed to at least one of said fluid motors to change its speed without changing the output speed ratio between said one fluid motor and an adjacent fluid motor in said series flow circuit;

said variable fluid-displacement means being effective for synchronously changing the output speed of the remaining subsequent fluid motors in said series flow circuit to maintain the same speed ratio between said one fluid motor and each of said subsequent fluid motors as the speed of said one fluid motor is changed; and said variable displacement fluid pump being located in said series flow circuit after the last of said plurality of fluid motors to form a backward cascade system wherein the output speed of said last fluid motor is adapted to be maintained substantially constant.

14. A cascade fluid drive system comprising:

a power supply having a variable displacement fluid pump and means for driving said pump;

a plurality of fluid motors arranged in series flow circuit with each other and said fluid pump so that a change in the output of said pump tends to cause a change in the output speeds of said fluid motors;

variable fluid-displacement means for selectively varying the amount of fluid directed to at least one of said fluid motors to change its speed without changing the output speed ratio between said one fluid motor and an adjacent fluid motor in said series flow circuit;

said variable fluid-displacement means being effective for synchronously changing the output speed of the remaining subsequent fluid motors in said series flow circuit to maintain the same speed ratio between said one fluid motor and each of said subsequent fluid motors as the speed of said one fluid motor is changed; and said variable displacement fluid pump being located in said series flow circuit immediately preceding an intermediate one of said plurality of fluid motors so that said system operates in a forward cascade manner for stages subsequent to the stage corresponding to said intermediate fluid motor and operates in a backward manner for stages preceding the stage corresponding to said intermediate fluid motor; and wherein the output speed of said intermediate stages is adapted to be maintained substantially constant.

15. A cascade fluid drive system comprising:

a power supply having a variable displacement fluid pump and means for driving said pump;

a plurality of fluid motors arranged in series flow circuit with each other and said fluid pump so that a change in the output of said pump tends to cause a change in the output speeds of said fluid motors;

variable fluid-displacement means for selectively varying the amount of fluid directed to at least one of said fluid motors to change its speed without changing the output speed ratio between said one fluid motor and an adjacent fluid motor in said series flow circuit;

said variable fluid-displacement means being effective for synchronously changing the output speed of the remaining subsequent fluid motors in said series flow circuit to maintain the same speed ratio between said one fluid motor and each of said subsequent fluid motors as the speed of said one fluid motor is changed; and said variable fluid-displacement means being connected in said series flow circuit in series with said one fluid motor, and arranged for selectively diverting fluid from said circuit on the inlet side of said one fluid motor.

16. The system of claim 15 wherein said variable fluid-displacement means includes a variable displacement fluid motor connected to a fixed displacement fluid motor and arranged so that said diverted fluid passes through said variable displacement fluid motor and said fixed displacement fluid motor is in series with said one fluid motor.

17. The system of claim 16 including a reservoir and wherein said diverted fluid is directed to said reservoir and said variable displacement fluid pump is supplied from said reservoir means.

18. A cascade fluid drive system comprising:

a power supply having a variable displacement fluid pump and means for driving said pump;

a plurality of fluid motors arranged in series flow circuit with each other and said fluid pump so that a change in the output of said pump tends to cause a change in the output speeds of said fluid motors;

variable fluid-displacement means for selectively varying the amount of fluid directed to at least one of said fluid motors to change its speed without changing the output speed ratio between said one fluid motor and an adjacent fluid motor in said series flow circuit;

said variable fluid-displacement means being effective for synchronously changing the output speed of the remaining subsequent fluid motors in said series flow circuit to maintain the same speed ratio between said one fluid motor and each of said subsequent fluid motors as the speed of said one fluid motor is changed; and said variable fluid-displacement means being adapted to be selectively operated as a variable displacement fluid pump or a variable displacement fluid motor.

* * * * *